United States Patent [19]

Kellogg et al.

[11] 3,999,176

[45] Dec. 21, 1976

[54] INDICATOR LIGHT CIRCUIT PROVIDING NORMAL AND EMERGENCY INDICATION

[75] Inventors: Walter J. Kellogg; Glenn R. Taylor; Wardell Gary, all of Beaver, Pa.

[73] Assignee: Westinghouse Electric Corporation, Pittsburgh, Pa.

[22] Filed: Apr. 7, 1975

[21] Appl. No.: 565,499

[52] U.S. Cl. ..... 340/253 A; 340/213 R; 340/331

[51] Int. Cl.[2] ..... G08B 21/00

[58] Field of Search ..... 340/253 R, 253 A, 248 R, 340/248 C, 249, 213 R, 213.1, 415, 331; 315/129, 133, 135, 136; 179/18 G, 18 FF, 27 B, 27 CA, 27 F, 27 G, 27 FA, 42, 58; 200/314; 307/115

[56] References Cited

UNITED STATES PATENTS 3,107,348 10/1963 McNeill ..... 340/213.1

3,246,310 4/1966 Keller et al. ..... 340/213 R X

*Primary Examiner*—John W. Caldwell
*Assistant Examiner*—Daniel Myer
*Attorney, Agent, or Firm*—Robert E. Converse, Jr.

[57] ABSTRACT

An indicator light circuit utilizing a single lamp and providing continuous illumination during normal operation and on and off flashing during an emergency condition. The circuit can also provide an indication wherein the lamp is continuously on but pulsating bright and dim. The indicator light circuit can thus provide four visual indications: (1) Off; (2) Normal on; (3) Flashing on and off; and, (4) On, but pulsating bright and dim. The invention is particularly adaptable for use to provide motor running and relay trip indication.

15 Claims, 2 Drawing Figures

INDICATOR LIGHT CIRCUIT PROVIDING NORMAL AND EMERGENCY INDICATION

BACKGROUND OF THE INVENTION

1. Field of the Invention

This invention is related to indicator light circuits and more particularly to an indicator light circuit wherein a single indicator lamp is operated in a variety of modes providing different indications.

2. Description of the Prior Art

Some prior art indicating circuits utilize two bulbs for indicating a normal condition and an overload condition. The disadvantage of this construction is that two separate light units, with the associated transformers, are required. In addition the two bulb indicating circuits of the prior art do not provide a flashing light to draw attention to the emergency condition.

SUMMARY OF THE INVENTION

An alternating current novel indicator light circuit is provided which utilizes only one bulb and the associated transformer for indicating a normal and an emergency condition. The disclosed alternating current signal light circuit comprises a signal light, a first circuit connected to the signal light which when activated continuously energizes the signal light and a second circuit connected to the signal light which when activated intermittently energizes the signal light. When the signal light is energized only from the first circuit it is on continuously at a constant level of illumination. When the signal light is energized only from the second signal circuit it flashes on and off. When the signal light is activated from the first and second circuits together the signal light is on continuously but varies between a bright and dim illumination level.

In one embodiment of the invention the first circuit utilizes a first switch, which is switchable to an open position, inhibiting current flow therethrough, and a closed position, permitting current therethrough, connected in series with a first rectifier to allow current of a selected polarity to flow to energize the indicator lamp. The second circuit utilizes a second switch, switchable to a conducting position in response to an external signal. This second switch can be a thyristor. The thyristor is disposed so as to allow current flow, when conducting, of a polarity opposite to that passed by the first rectifier. A timing circuit is connected to the gate of the thyristor to turn the thyristor on and off at discrete intervals when energized. With current flowing through the first and second circuits the indicator lamp is energized with a full alternating current wave. When conduction of either the first or second circuit is inhibited the indicator lamp can be excited at most with a one half rectified wave.

Operation of the first and second circuits can be controlled by individual switches or by devices such as overload protective devices which are activated only during emergency conditions. The timing circuit which is connected to the gate of the thyristor utilizes a timing capacitor, a rectifying diode, charging resistors, and a selected diac. During operation the timing capacitor charges up to a voltage level at which the diac breaks down and conducts a current which triggers the thyristor. The capacitor continues to discharge through the diac triggering circuit until the lower voltage turn-off level of the diac is reached, at which time the diac stops conducting and the capacitor is again starting to be charged.

It is an object of this invention to teach an alternating current indicator light circuit utilizing only a single bulb which is operated at a continuous lumination during normal operation and at a flashing operation during overload conditions.

It is a further object of this invention to teach an indicator light circuit wherein a single bulb provides a continuous on indication, a flashing on and off indication, and a continuous on pulsating bright and dim indication.

BRIEF DESCRIPTION OF THE DRAWINGS

For a better understanding of the invention, reference may be had to the preferred embodiment exemplary of the invention shown in the accompanying drawings in which.

DESCRIPTION OF THE PREFERRED EMBODIMENT

Figure 1:
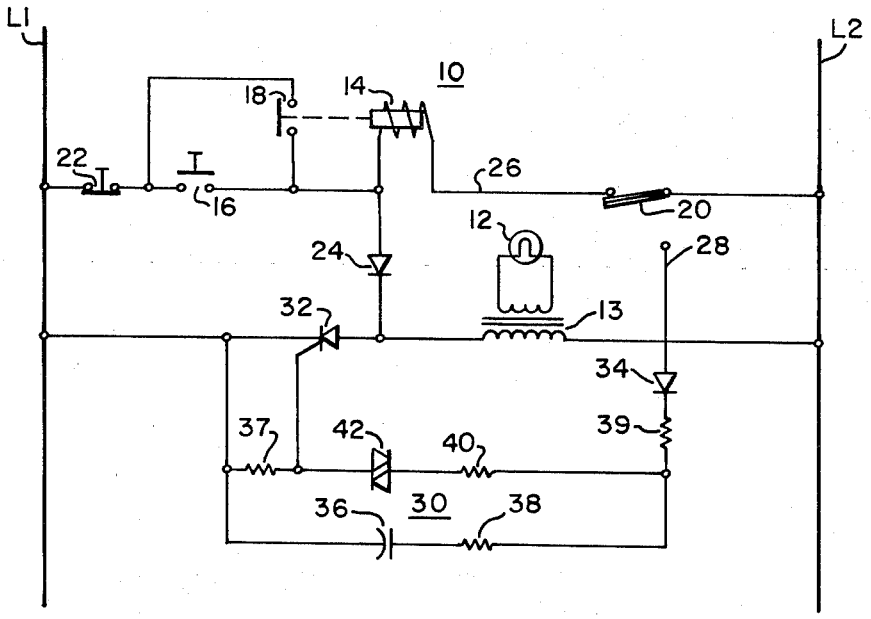
FIG. 1 shows a schematic of a motor controlled circuit utilizing the teaching of the present invention; and, FIG. 2 shows a modified indicator light circuit similar to the one utilized in FIG. 1.

Referring now to the drawings and FIG. 1 in particular, there is shown an indicator light circuit 10 utilizing the teaching of the present invention. An indicator lamp 12 is provided for giving various indications. The indicator circuit 10 can provide four modes for the light 12: Off; Normal on; Flashing on and off; and Continuously on but pulsating. A coil 14 is provided which can control a relay or motor starter. When start button 16 is depressed coil 14 is energized, closing normally open contacts 18. An overload protective device 20 shown in its normal position in FIG. 1 is provided in series with coil 14. A stop button 22 is also provided in series with coil 14 for normal stop operation. Thus with coil 14 energized and no overload present a continuous current path exists from line to line through stop button 22, contacts 18, coil 14 and overload protective device 20. A step-down transformer 13 is provided for energizing lamp 12. Lamp 12 is connected to the secondary of transformer 13. This permits a low cost, low voltage lamp 12 to be used and provides for personnel safety. A diode 24 is provided to connect signal transformer 13 in parallel with the coil 14. Thus during normal operation with coil 14 energized transformer 13 is fed a half rectified current wave through diode 24 causing lamp 12 to be continuously lit at a constant illumination level. During an overload condition overload protective device 20 switches from contact with line 26 and coil 14 to contact with line 28. This interrupts the series circuit through coil 14, deenergizing coil 14, causing contact 18 to open and interrupting current flow through diode 24. When this happens, lamp 12 goes off. When overload protective device 20 switches into contact with line 28 a timing circuit 30 is activated. An SCR or thyristor 32 is connected in series with transformer 13 across the incoming lines L1 and L2. When thyristor 32 is activated transformer 13 is energized by a one half rectified current wave. Note that thyristor 32 allows current flow of a polarity which is opposite to the current flow permitted by diode 24. Thus when thyristor 32 alone is energized lamp 12 is lit with the same brilliance as is accomplished when current flow is only through contact 18 and diode 24. When overload protective device 20 switches to the lower position in contact with line 28 current begins to flow through timing circuit 30. A diode 34 is provided to allow only direct current to flow in the timing circuit. Timing capacitor 36 is provided which is charged up to a selected potential by the current flow in the timing circuit 30. Resistors 38 and 39 determine the rate at which capacitor 36 is charged. Resistor 40 and diac 42 are provided in parallel with capacitor 36. When capacitor 36 is charged to a high enough voltage above the diac 42 breakdown level, diac 42 starts to conduct and capacitor 36 is discharged through resistors 37, 38 and 40. As capacitor 36 discharges SCR 32 is turned on. This in turn causes lamp 12 to light. Capacitor 36 continues to discharge and when a sufficiently low voltage is reached diac 42 switches to a nonconducting state and capacitor 36 begins to be charged again. This cycle continues switching thyristor 32 on and off and in turn lamp 12 on and off until overload protective device 20 is reset to the normal position. With overload protective device 20 completing the circuit through line 28 lamp 12 thus flashes on and off. If during this time, start button 16 is depressed, current flow will also occur through diode 24 to light lamp 12. Under these conditions when SCR 32 is conducting, full wave alternating current will be applied to transformer 13 brightly lighting lamp 12. During the period of nonconduction of thyristor 32 lamp 12 will still be lit by current flow through diode 24. Thus, with timing circuit 30 activated and start button 16 depressed, lamp 12 will remain continuously on but will pulsate between a bright level and a dim level.

Figure 2:
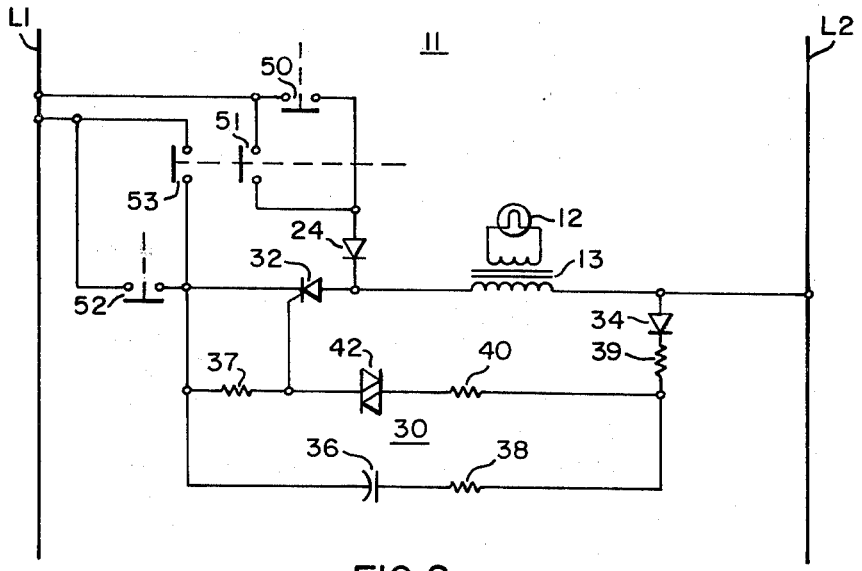

Referring now to FIG. 2 there is shown an indicator light circuit 11 similar to the circuit shown in FIG. 1 and wherein equivalent parts are given the same reference number. Operation of lamp 12 is controlled by four pairs of contacts 50, 51, 52 and 53. Contacts 51 and 53 are controlled by a common coil (not shown) and are open and closed at the same time. When contact 50 alone is closed a circuit is completed through diode 24 and transformer 13 energizing transformer 13 with half wave rectified current. Lamp 12 is thus continuously on at a constant level. When contacts 52 are closed and the other contacts are open, timing circuit 30 is energized and when SCR 32 conducts a half rectified wave energizes transformer 13. As in circuit 10, thyristor 32 only allows current flow of a polarity opposite to the current flow permitted by diode 24. When contacts 51 and 53 are closed and the other contacts are open, lamp 12 is maintained continuously on but flashes bright and dim. Note that closing contacts 51 and 53 is equivalent to closing contact 50 and 52. Thus, with this disclosed circuit a single lamp 12 can provide four different indications.

We claim:

1. An alternating current indicator light circuit comprising:

an indicator lamp;

first switch means switchable between an open position inhibiting current flow therethrough and a closed position permitting flow therethrough, said first switch means being disposed to energize said indicator lamp when in the closed position;

second switch means switchable in response to a trigger signal between an open position inhibiting current flow therethrough and a closed position permitting current flow therethrough, said second switch means being disposed to energize said indicator when in the closed position; and timing means connected to said second switch means for triggering said second switch means to a closed position at periodic intervals when energized.

2. An alternating current indicator light circuit as claimed in claim 1 comprising:

first rectifier means disposed in series with said first switch means to allow current of a selected polarity to flow to energize said indicator lamp when said first switch means is in the closed position; and, second rectifier means disposed in series in the circuit containing said second switch means to allow current flow of an opposite polarity as allowed by said first rectifier means to flow to energize said indicator lamp when said second switch means is in the closed position.

3. An alternating current indicator light circuit as claimed in claim 2 wherein said timing means comprises:

a capacitor;

a plurality of resistors connected to regulate charging and discharging of said capacitor; and, a diac connected in parallel with said capacitor and operable to conduct when the charge on said capacitor reaches a predetermined voltage level and supply a trigger signal to said second switch means.

4. An alternating current indicator light circuit as claimed in claim 3 wherein:

said second switch means comprises a thyristor; and, said second rectifier means comprises the same thyristor.

5. An alternating current indicator light circuit as claimed in claim 4 comprising:

a transformer connected in the indicator light circuit having said indicator lamp connected to the transformer secondary.

6. An alternating current signal light circuit for use with the overload protected coil of electric apparatus comprising:

lamp means;

a first circuit comprising first switch means switchable between a closed position wherein the coil is energized and an open position wherein the coil is not energized, and a rectifier, said first circuit being connected to energize said lamp means when said first switchable means is closed;

a second circuit comprising a thyristor connected to energize said lamp means when a gate signal is applied, said thyristor being operable when activated to permit rectified current flow of a polarity opposite that allowed to flow through said lamp means by said first circuit; and a third circuit comprising a timing circuit connected to a thyristor gate to periodically activate said thyristor, and a second switchable means which is maintained in a closed position when an overload occurs activating said timing circuit.

7. An alternating current signal light circuit as claimed in claim 6 wherein:

said lamp means comprises a lamp and a step-down transformer; and, said timing circuit comprises a plurality of resistors, a rectifier, a capacitor, and a diac connected to periodically activate said thyristor.

8. A signal circuit comprising:

an indicator;

a first electrical path through said indicator comprising a first switch and a diode in series;

a second electrical path through said indicator comprising a second switch and an SCR in series; and, a third electrical path around said indicator disposed to be activated when said second switch is closed and comprising a timer connected to the gate of said SCR for activating said SCR at spaced apart intervals.

9. A signal circuit as claimed in claim 8 wherein:

said diode and said SCR are disposed to permit current flow of opposite polarity.

10. A signal circuit as claimed in claim 9 wherein said timer comprises:

a capacitor connected to the gate of said SCR; and, a diac and a resistor connected in parallel with said capacitor.

11. Indicator light circuit for an overload protective motor controller comprising:

an indicator light;

a first circuit which is activated when the motor is running, said first circuit being connected to said indicator lamp to continuously light said indicator lamp;

a second circuit which is activated when the motor overload protection is tripped, said second circuit being connected to said indicator lamp for flashing said indicator lamp on and off; and said first circuit and said second circuit being interconnected so if said first circuit is activated while said second circuit is activated said indicator lamp is continuously on and flashing brighter and dimmer.

12. An indicator light circuit as claimed in claim 11 wherein:

said first circuit comprises a set of contacts, responsive to the operation of an external device, and a diode; and said second circuit comprises a switchable device responsive to an external signal, and a timing circuit connected to said switchable device for supplying the external signal.

13. An indicator light circuit as claimed in claim 12 wherein:

said switchable device is a thyristor; and said timing circuit supplies the external signal at discrete intervals.

14. An indicator light circuit as claimed in claim 13 wherein said timing device comprises:

a timing capacitor;

resistance charging means connected to said timing capacitor for control rate of charge; and a diac connected in parallel with said timing capacitor and being connected to the gate of said thyristor.

15. An alternating current indicator light circuit, comprising:

alternating current indicator light means comprising a transformer having a primary and a secondary winding, and an indicator lamp connected to said transformer secondary winding;

first switch means switchable between an open position preventing current flow therethrough and a closed position permitting current flow therethrough, said first switch means being disposed to energize said indicator light means when in the closed position;

second switch means switchable in response to a trigger signal between an open position preventing current flow therethrough and a closed position permitting current flow therethrough, said second switch means being disposed to energize said indicator light means when in the closed position; and timing means connected to said second switch means for triggering said second switch means to a closed position at periodic intervals when energized.

* * * * *